US009736593B1

(12) United States Patent
Tseng et al.

(10) Patent No.: US 9,736,593 B1
(45) Date of Patent: Aug. 15, 2017

(54) ELECTRO-ACOUSTIC TRANSDUCER

(71) Applicant: GlobalMEMS Co., Ltd., Grand Cayman (KY)

(72) Inventors: Shih-Hsiung Tseng, New Taipei (TW); Ming-Ching Wu, Taoyuan (TW)

(73) Assignee: GlobalMEMS Co., Ltd., Grand Cayman (KY)

( * ) Notice: Subject to any disclaimer, the term of this patent is extended or adjusted under 35 U.S.C. 154(b) by 0 days.

(21) Appl. No.: 15/131,041

(22) Filed: Apr. 18, 2016

(30) Foreign Application Priority Data

Feb. 16, 2016 (TW) ..... 105104420 A

(51) Int. Cl.

| | |
|---|---|
| ***H04R 25/00*** | (2006.01) |
| ***H04R 17/00*** | (2006.01) |
| ***H04R 19/00*** | (2006.01) |
| ***H04R 23/00*** | (2006.01) |

(52) U.S. Cl.
CPC ..... *H04R 17/005* (2013.01); *H04R 19/005* (2013.01); *H04R 23/006* (2013.01); *H04R 2201/003* (2013.01); *H04R 2217/01* (2013.01); *H04R 2400/01* (2013.01)

(58) Field of Classification Search
CPC ..... H04R 17/00; H04R 17/005; H04R 17/02; H04R 7/025; H04R 17/06; H04R 17/08; H04R 17/10; H04R 2217/01; H04R 2499/11; H04R 2499/15; H04R 17/025; H04R 19/005; H04R 19/02; H04R 23/006; H04R 2201/003
USPC ..... 381/114, 173, 182, 186, 190, 191, 113, 381/116, 174, 175; 310/322, 324, 328, 310/331, 348
See application file for complete search history.

(56) References Cited

U.S. PATENT DOCUMENTS 4,295,010 A * 10/1981 Murphy ..... H04R 17/005 310/331
4,469,920 A * 9/1984 Murphy ..... H04R 1/005 310/324
2005/0023937 A1* 2/2005 Sashida ..... B06B 1/0611 310/348

FOREIGN PATENT DOCUMENTS

TW I520625 2/2016

OTHER PUBLICATIONS

"Office Action of Taiwan Counterpart Application," issued on Feb. 10, 2017, p. 1-p. 4.

* cited by examiner

*Primary Examiner* — Huyen D Le
(74) *Attorney, Agent, or Firm* — Jianq Chyun IP Office

(57) ABSTRACT

An electro-acoustic transducer includes a base and a plurality of vibration portions. Each of the vibration portions includes a piezoelectric transduction layer and has two connection ends and a free end. The connection portions are connected to the base, and the free ends are separated from one another. The piezoelectric transduction layers are adapted to receive electrical signals to deform, such that the vibration portions are driven to vibrate and generate corresponding acoustic waves. The vibration portions are adapted to receive acoustic waves to vibrate, such that the piezoelectric transduction layers are driven to deform and generate corresponding electrical signals.

6 Claims, 4 Drawing Sheets

ELECTRO-ACOUSTIC TRANSDUCER

CROSS-REFERENCE TO RELATED APPLICATION

This application claims the priority benefit of Taiwan application serial no. 105104420, filed on Feb. 16, 2016. The entirety of the above-mentioned patent application is hereby incorporated by reference herein and made a part of this specification.

BACKGROUND

Field of the Invention

The invention relates to an electro-acoustic transducer and more particularly, to a piezoelectric type electro-acoustic transducer.

Description of Related Art

An electro-acoustic transducer can be applied to a sound input device, e.g., a microphone, and a sound output device, e.g., a speaker. Taking a piezoelectric type electro-acoustic transducer as an example, an electrical signal is applied to an upper and a lower electrodes of a piezoelectric material to deform the piezoelectric material by utilizing a transverse piezoelectric effect of the piezoelectric material, such that a corresponding vibration membrane is driven to vibrate and generate a corresponding acoustic wave. Otherwise, an acoustic wave may be applied to the vibration membrane, such that the corresponding piezoelectric material are driven to vibrate and deform to generate a corresponding electrical signal by utilizing the direct piezoelectric effect of the piezoelectric material.

Consumer electronic products, such as smart phones, notebook computers, tablet PCs are commonly equipped with microphones and speakers. Under the trend that consumers chase for high quality and multi-functional consumer electronic products, the industry is looking forward to applying advanced technologies to develop and manufacture electro-acoustic transducers applicable to the microphones and the speakers, so as to enhance product competitiveness in the market. Therefore, how to effectively improve electro-acoustic transduction efficiency of the sound input/output devices is an important subject of the research and development (R&D) field of the electro-acoustic transducers.

SUMMARY

The invention provides an electro-acoustic transducer having good electro-acoustic transduction quality.

The electro-acoustic transducer of the invention includes a base and a plurality of vibration portions. Each of the vibration portions includes a piezoelectric transduction layer and has two connection ends and a free end. The connection portions are connected to the base, and the free ends are separated from one another. The piezoelectric transduction layers are adapted to receive electrical signals to deform, such that the vibration portions are driven to vibrate and generate corresponding acoustic waves. The vibration portions are adapted to receive acoustic waves to vibrate, such that the piezoelectric transduction layers are driven to deform and generate corresponding electrical signals.

In an embodiment of the invention, the base has an opening, the vibration portions are located in the opening, and the connection ends are connected to an inner edge of the opening.

In an embodiment of the invention, a notch is provided between each of the vibration portions and the inner edge of the opening, and the notch is located between two connection ends.

In an embodiment of the invention, the base has a plurality of extending portions, and the extending portions are connected to the inner edge of the opening, respectively aligned with the notches and separated from the vibration portions.

In an embodiment of the invention, each of the vibration portions further comprises a carrying layer, the piezoelectric transduction layer is disposed on the carrying layer, the piezoelectric transduction layer is adapted to deform relatively to the carrying layer to drive the vibration portion to vibrate, and the vibration portion is adapted to vibrate to drive the piezoelectric transduction layer to deform relatively to the carrying layer.

In an embodiment of the invention, a material of the carrying layer includes a non-piezoelectric material.

In an embodiment of the invention, each of the piezoelectric transduction layers includes an upper electrode layer, a piezoelectric material layer and a lower electrode layer, and the piezoelectric material layer is disposed between the upper electrode layer and the lower electrode layer.

In an embodiment of the invention, the upper electrode layer is aligned with the connection end.

To sum up, in the electro-acoustic transducer of the invention, each of the vibration portions not only is connected to the base through the two connection ends thereof, but also has the free end. In this way, after the integrated base and vibration portions are manufactured, an unexpected internal stress in the overall structure can be released through the free end. Thus, when electric signals are input to the piezoelectric transduction layers to drive the vibration portions to vibrate and generate the corresponding acoustic waves, accuracy of outputting the acoustic waves is not affected by the internal stress. Moreover, when the vibration portions receive the acoustic waves to drive the piezoelectric transduction layers to deform and generate the corresponding electrical signals, accuracy of outputting the electric signals is not affected by the internal stress. In this way, the electro-acoustic transducer has good electro-acoustic transduction quality.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
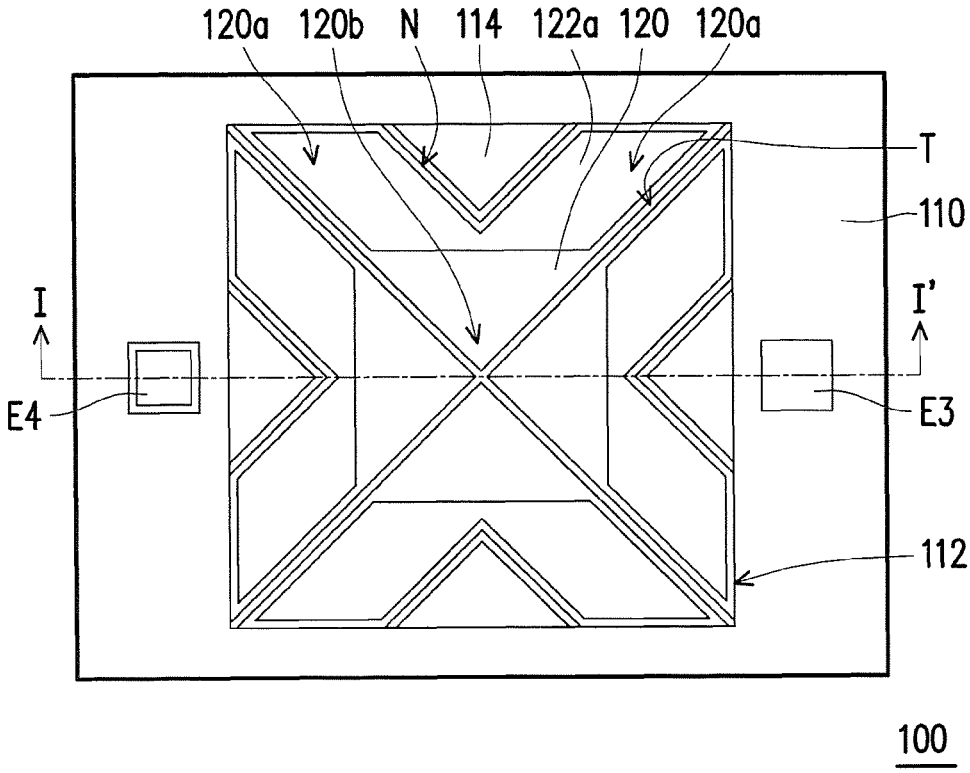
FIG. 1 is a schematic top view illustrating an electro-acoustic transducer according to an embodiment of the invention.
Figure 2:
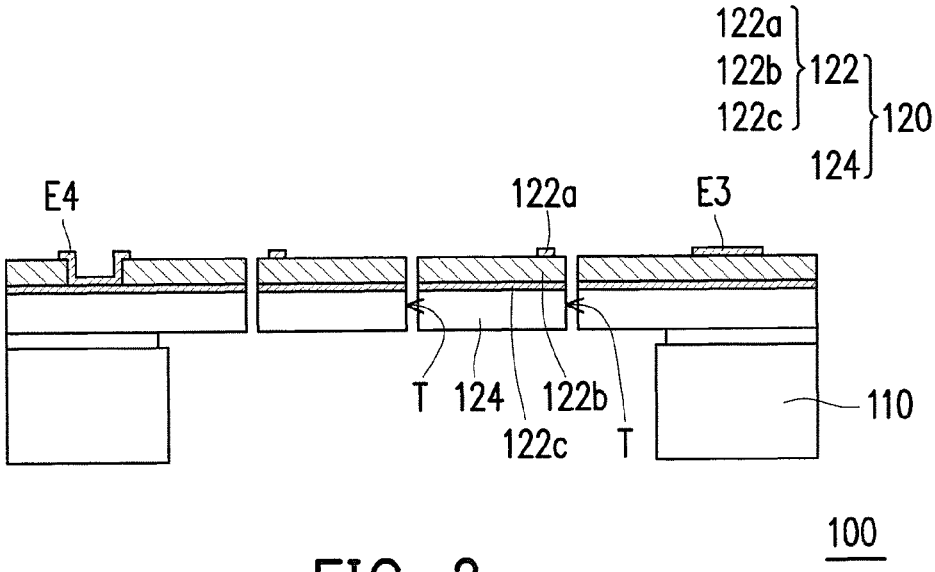
FIG. 2 is a schematic cross-sectional view of the electro-acoustic transducer depicted in FIG. 1 along line I-I.

FIG. 1 is a schematic top view illustrating an electro-acoustic transducer according to an embodiment of the invention. FIG. 2 is a schematic cross-sectional view of the electro-acoustic transducer depicted in FIG. 1 along line I-I. Referring to FIG. 1 and FIG. 2, an electro-acoustic transducer 100 of the present embodiment is manufactured by, for example, a micro electro mechanical system (MEMS) process and may be applied to a sound input device (e.g., a microphone), a sound output device, (e.g., a speaker) or an ultrasound transducer. The electro-acoustic transducer 100 includes a base 110 and a plurality of vibration portions 120 (illustrated as four herein). Each of the vibration portions 120 includes a piezoelectric transduction layer 122 (which is illustrated in FIG. 2). The piezoelectric transduction layers 122 are adapted to receive electrical signals to deform, such that the vibration portions 120 are driven to vibrate and generate corresponding acoustic waves. In addition, the vibration portions 120 are adapted to receive acoustic waves to vibrate, such that the piezoelectric transduction layers 122 are driven to deform and generate corresponding electrical signals.

In the present embodiment, each of the vibration portions 120 has two connection ends 120*a* and a free end 120*b*. The connection ends 120*a* are connected to the base 110, and the free ends 120*b* are separated from one another. In this disposition manner, after the integrated base 110 and vibration portions 120 are manufactured, an unexpected internal stress in the overall structure can be released through the free ends 120*b*. Accordingly, when the electric signals are input to the piezoelectric transduction layers 122 to drive the vibration portions to vibrate and generate the corresponding acoustic waves, accuracy of outputting the acoustic waves is not affected by the internal stress. In addition, when the vibration portions 120 receive the acoustic waves to drive the piezoelectric transduction layers 122 to deform and generate the corresponding electric signals, accuracy of outputting the electric signals is not affected by the internal stress. In this way, the electro-acoustic transducer 100 has good electro-acoustic transduction quality.

In the present embodiment, referring to FIG. 1, the base 110 has an opening 112, the vibration portions 120 are located in the opening 112, and the connection ends 120*a* are connected to an inner edge of the opening 112. A notch N is provided between each of the vibration portions 120 and the inner edge of the opening 112, and the notch N is located between two connection ends 120*a*, such that the vibration portions 120 become a vibration structure supported by two ends with the presence of the two connection ends 120*a* which are separated from each other. The base 110 has a plurality of extending portions 114 (illustrated as four herein), the extending portions 114 are connected to the inner edge of the opening 120, respectively aligned with the notches N and separated from the vibration portions 120. Each notch N between two connection ends 120*a* is shielded by the extending portion 114, so as to avoid loss of acoustic waves from the notch N.

In addition, each of the vibration portions 120 further includes a carrying layer 124, as illustrated in FIG. 2. The piezoelectric transduction layer 122 is disposed on the carrying layer 124, and the piezoelectric transduction layer 122 is adapted to expandably and contractibly deform relatively to the carrying layer 124, such that the vibration portion 120 is driven to vibrate, and the vibration portion 120 is adapted to receive acoustic waves to vibrate, such that the piezoelectric transduction layer 122 is driven to expandably and contractibly deform relatively to the carrying layer 124 and accordingly generate corresponding electrical signals. The carrying layer 124 is, for example, a device layer made of silicon on insulator (SOI) or other adaptive non-piezoelectric materials, but the invention is not limited thereto. The base 110 is, for example, a handle layer made of SOI or other adaptive materials, which is not limited in the invention.

To be more detailed, each of the piezoelectric transduction layers 122 of the present embodiment includes an upper electrode layer 122*a*, a piezoelectric material layer 122*b* and a lower electrode layer 122*c*. The piezoelectric material layer 122*b* is disposed between the upper electrode layer 122*a* and the lower electrode layer 122*c*. A material of the upper electrode layer 122*a* includes, for example, but not limited to, gold (Au), and the upper electrode layer 122*a* is aligned with the connection ends 120*a*. A material of the lower electrode layer 122*c* includes, for example, but not limited to, platinum (Pt). Moreover, the upper electrode layer 122*a* and the lower electrode layer 122*c* further extend to places above the base 100 and respectively have an electrode E3 and an electrode E4 above the base 110. Electrical signals may be input to or output from the electro-acoustic transducer 100 through the upper electrode layer 122*a*, the electrode E3 of the upper electrode layer 122*a* and the electrode E4 of the lower electrode layer 122*c*.

Figure 3:
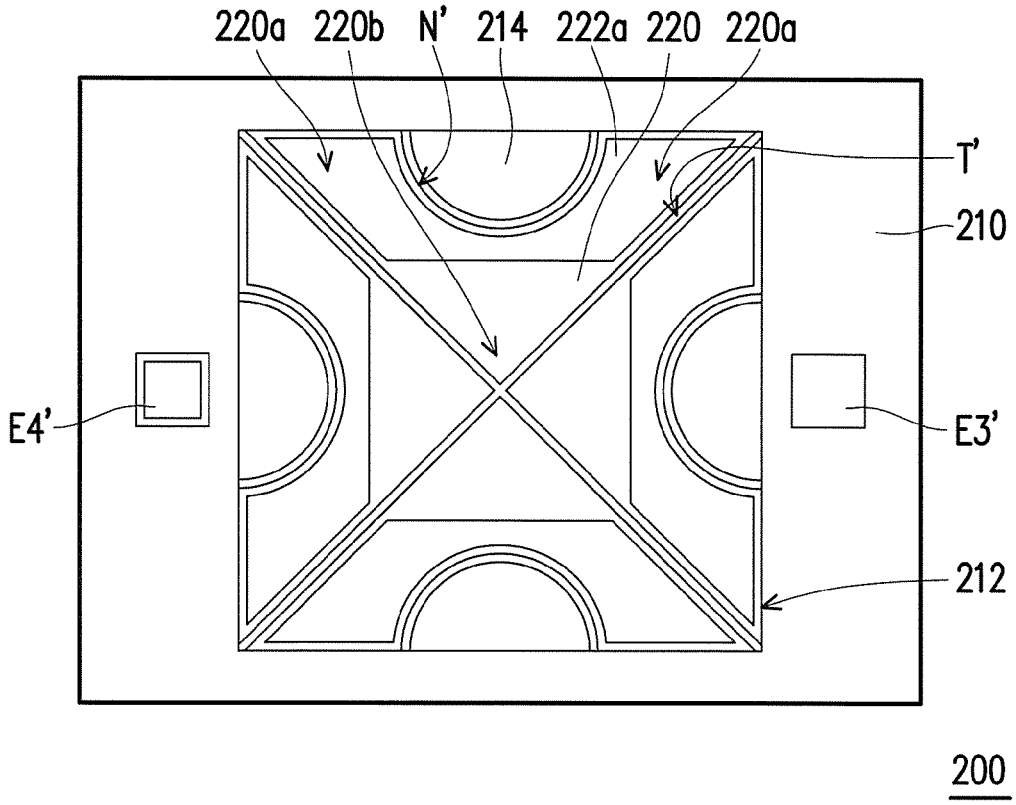
FIG. 3 is a schematic top view illustrating an electro-acoustic transducer according to another embodiment of the invention.

FIG. 3 is a schematic top view illustrating an electro-acoustic transducer according to another embodiment of the invention. In an electro-acoustic transducer 200 illustrated in FIG. 3, the disposition and operations of a base 210, an opening 212, extending portions 214, vibration portions 220, connection ends 220*a*, free ends 220*b*, upper electrode layers 222*a*, an electrode E3', an electrode E4', notches N', trenches T' are similar to those of the base 110, the opening 112, the extending portions 114, the vibration portions 120, the connection ends 120*a*, the free ends 120*b*, the upper electrode layers 122*a*, the electrode E3, the electrode E4, the notches N and the trenches T illustrated in FIG. 1 and will not repeatedly described. The electro-acoustic transducer 200 is different from the electro-acoustic transducer 100 in shapes of the notches N' and the extending portions 214 being semicircular instead of being triangular as illustrated in FIG. 1. In other embodiments, the notches and the extending portions may also be in other adaptive shapes, which are not limited in the invention.

Figure 4A:
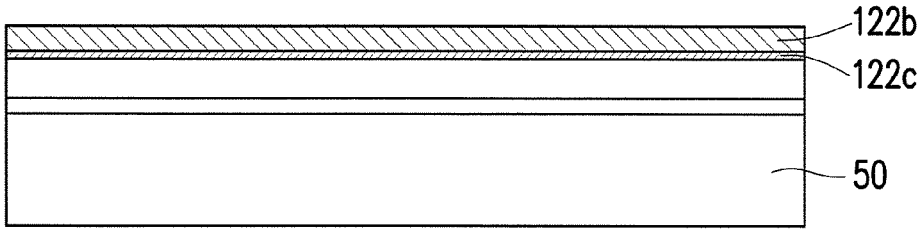
FIG. 4A to FIG. 4C are schematic views illustrating a manufacturing process of the electro-acoustic transducer depicted in FIG. 1.
Figure 4B:
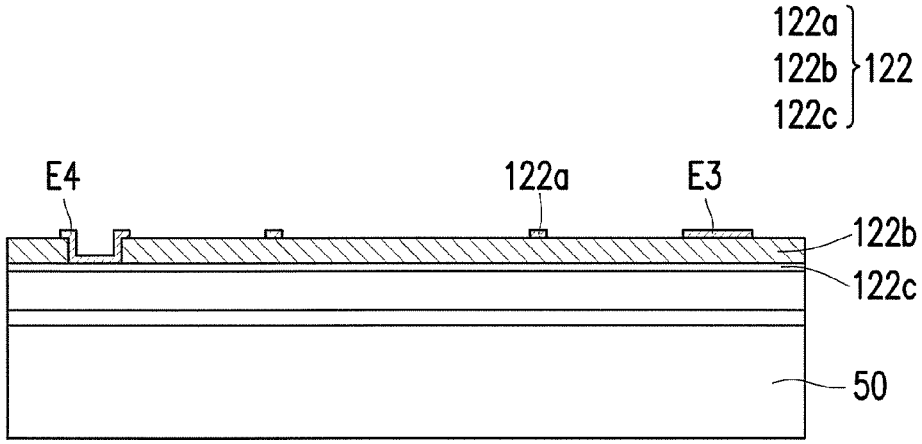
Figure 4C:
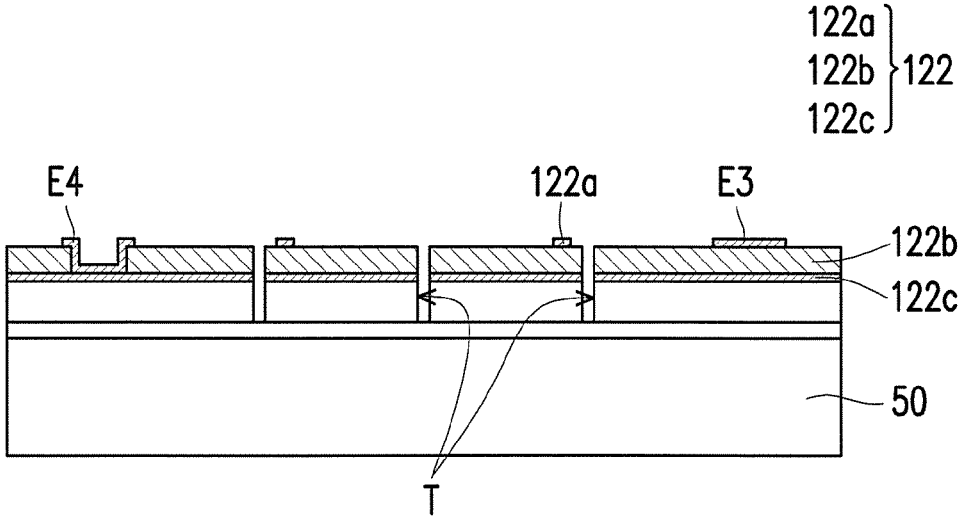

The electro-acoustic transducer 100 illustrated in FIG. 1 serves as an example below for describing a manufacturing process thereof. FIG. 4A to FIG. 4C are schematic views illustrating a manufacturing process of the electro-acoustic transducer depicted in FIG. 1. First, referring to FIG. 4A, a lower electrode layer 122*c* and a piezoelectric material layer 122*b* are formed on a substrate 50. Then, referring to FIG. 4B, an upper electrode layer 122*a* is formed on the piezoelectric material layer 122*b*. The upper electrode layer 122*a*, the piezoelectric material layer 122*b* and the lower electrode layer 122*c* form a piezoelectric transduction layer 122, the upper electrode layer 122*a* and the lower electrode layer 122*c* respectively have an electrode E3 and an electrode E4, and the upper electrode layer 122*a*, the electrode E3 of the upper electrode layer 122*a* and the electrode E4 of the lower electrode layer 122*c* are coplanar, for example. Referring to FIG. 4C, trenches T are formed above the substrate 50 and in the piezoelectric transduction layer 122, and part of the substrate 50 is removed in a way as illustrated in FIG. 2 to separate and form vibration portions 120 and extending portions 114. For example, the trenches T are formed by a dry etching process, such that each trench T has a small width for avoid loss in the acoustic waves through the trenches T. However, the invention is not limited thereto. The trenches T may also be formed by an ion milling process or a deep reactive ion etching (DRIE) process.

Based on the above, in the electro-acoustic transducer of the invention, each of the vibration portions not only is connected to the base through the two connection ends thereof, but also has the free end. In this way, after the integrated base and vibration portions are manufactured, the unexpected internal stress in the overall structure can be released through the free ends. Accordingly, when the electric signals are input to the piezoelectric transduction layers, such that the vibration portions are driven to vibrate and generate the corresponding acoustic waves, accuracy of outputting the acoustic waves is not affected by the internal stress. In addition, when the vibration portions receive the acoustic waves, such that the piezoelectric transduction layers are driven to deform and generate the corresponding electric signals, accuracy of outputting the electric signal is not affected by the internal stress. In this way, the electro-acoustic transducer can have good electro-acoustic transduction quality.

Although the invention has been disclosed by the above embodiments, they are not intended to limit the invention. It will be apparent to one of ordinary skill in the art that modifications and variations to the invention may be made without departing from the spirit and scope of the invention. Therefore, the scope of the invention will be defined by the appended claims.

What is claimed is:

1. An electro-acoustic transducer, comprising:

a base; and a plurality of vibration portions, wherein each of the vibration portions comprises a piezoelectric transduction layer and has two connection ends and a free end, the connection ends are connected to the base, the free ends are separated from one another, the piezoelectric transduction layers are adapted to receive electrical signals to deform, such that the vibration portions are driven to vibrate and generate corresponding acoustic waves, and the vibration portions are adapted to receive acoustic waves to vibrate, such that the piezoelectric transduction layers are driven to deform and generate corresponding electrical signals, wherein the base has an opening, the vibration portions are located in the opening, the connection ends are connected to an inner edge of the opening, and a notch is provided between each of the vibration portions and the inner edge of the opening, and the notch is located between the two connection ends.

2. The electro-acoustic transducer according to claim 1, wherein the base has a plurality of extending portions, and the extending portions are connected to the inner edge of the opening, respectively aligned with the notches and separated from the vibration portions.

3. The electro-acoustic transducer according to claim 1, wherein each of the vibration portions further comprises a carrying layer, the piezoelectric transduction layer is disposed on the carrying layer, the piezoelectric transduction layer is adapted to deform relatively to the carrying layer to drive the vibration portion to vibrate, and the vibration portion is adapted to vibrate to drive the piezoelectric transduction layer to deform relatively to the carrying layer.

4. The electro-acoustic transducer according to claim 3, wherein a material of the carrying layer comprises a non-piezoelectric material.

5. The electro-acoustic transducer according to claim 1, wherein each of the piezoelectric transduction layers comprises an upper electrode layer, a piezoelectric material layer and a lower electrode layer, and the piezoelectric material layer is disposed between the upper electrode layer and the lower electrode layer.

6. The electro-acoustic transducer according to claim 5, wherein the upper electrode layer is aligned with the connection ends.

* * * * *